US010612823B2

(12) United States Patent
Moreaux

(10) Patent No.: US 10,612,823 B2
(45) Date of Patent: Apr. 7, 2020

(54) CONDENSER

(71) Applicant: Daikin Applied Americas Inc., Minneapolis, MN (US)

(72) Inventor: Louis A. Moreaux, Minneapolis, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 84 days.

(21) Appl. No.: 15/423,778

(22) Filed: Feb. 3, 2017

(65) Prior Publication Data

US 2018/0224172 A1 Aug. 9, 2018

(51) Int. Cl.
*F25B 39/00* (2006.01)
*F28D 7/16* (2006.01)
(Continued)

(52) U.S. Cl.
CPC ..... *F25B 39/00* (2013.01); *F25B 39/04* (2013.01); *F28D 7/163* (2013.01); *F28D 7/1646* (2013.01); *F28F 9/0131* (2013.01); *F28F 9/026* (2013.01); *F28F 9/0214* (2013.01); *F28F 9/0224* (2013.01); *F25B 2339/046* (2013.01); *F25B 2339/047* (2013.01); *F28D 2021/007* (2013.01); *F28D 2021/0063* (2013.01)

(58) Field of Classification Search
CPC .... F01P 7/16; F28F 25/02; F28F 25/04; F28F 39/00; F28F 39/04; F28F 2339/047; F28D 3/02; F28D 3/04
USPC ..... 165/115, 117, 161
See application file for complete search history.

(56) References Cited

U.S. PATENT DOCUMENTS 3,167,927 A * 2/1965 Lynch ..... F25B 15/06 62/56
3,861,460 A * 1/1975 Lenhardt ..... F28B 1/02 165/111

(Continued)

FOREIGN PATENT DOCUMENTS

JP 2015-64157 A 4/2015

OTHER PUBLICATIONS

International Search Report for the corresponding international application No. PCT/US2018/013946, dated Mar. 27, 2018.

(Continued)

*Primary Examiner* — Filip Zec
(74) *Attorney, Agent, or Firm* — Global IP Counselors, LLP

(57) ABSTRACT

A condenser for a vapor compression system includes a shell and a tube bundle. The shell has a refrigerant inlet and a refrigerant outlet. The tube bundle includes a plurality of heat transfer tubes disposed inside the shell. Refrigerant discharged from the refrigerant inlet is supplied onto the tube bundle. The heat transfer tubes extend generally parallel to the longitudinal center axis of the shell. The heat transfer tubes are arranged to form a first vapor passage extending generally vertically along a first passage lengthwise direction through at least some of the heat transfer tubes. The first vapor passage has a first minimum width measured perpendicularly relative to the first passage lengthwise direction and the longitudinal axis. The first minimum width is larger than a tube diameter of the heat transfer tubes, and the first minimum width is smaller than four times the tube diameter.

11 Claims, 11 Drawing Sheets

(51) Int. Cl.

| | |
|---|---|
| ***F25B 39/04*** | (2006.01) |
| ***F28F 9/013*** | (2006.01) |
| ***F28F 9/02*** | (2006.01) |
| *F28D 21/00* | (2006.01) |

(56) References Cited

U.S. PATENT DOCUMENTS

| | | | | |
|---|---|---|---|---|
| 6,041,852 | A * | 3/2000 | Sato | F28B 9/10 165/114 |
| 6,269,867 | B1 * | 8/2001 | Takahashi | F28B 1/02 165/114 |
| 6,868,695 | B1 * | 3/2005 | Dingel | F25B 39/028 165/115 |
| 7,481,264 | B2 * | 1/2009 | Yoshii | F28B 1/02 165/111 |
| 2002/0046572 | A1 | 4/2002 | Iritani et al. | |
| 2004/0112573 | A1 * | 6/2004 | Moeykens | F25B 39/028 165/115 |
| 2014/0034275 | A1 * | 2/2014 | Grabon | F25B 23/006 165/159 |
| 2014/0127059 | A1 | 5/2014 | Haley et al. | |
| 2015/0007604 | A1 * | 1/2015 | Hu | F28F 9/028 62/507 |
| 2016/0040917 | A1 * | 2/2016 | Liu | F25B 39/04 62/117 |
| 2016/0076799 | A1 * | 3/2016 | Mahmoud | F01K 25/06 62/115 |

OTHER PUBLICATIONS

Written Opinion for the corresponding international application No. PCT/US2018/013946, dated Mar. 27, 2018.

International Preliminary Report on Patentability including Written Opinion for the corresponding international application No. PCT/US2018/013946, dated Aug. 6, 2019.

* cited by examiner

CONDENSER

BACKGROUND OF THE INVENTION

Field of the Invention

This invention generally relates to a condenser adapted to be used in a vapor compression system. More specifically, this invention relates to a condenser including a vapor passage.

Background Information

Vapor compression refrigeration has been the most commonly used method for air-conditioning of large buildings or the like. Conventional vapor compression refrigeration systems are typically provided with a compressor, a condenser, an expansion valve, and an evaporator. The compressor compresses refrigerant and sends the compressed refrigerant to the condenser. The condenser is a heat exchanger that allows compressed vapor refrigerant to condense into liquid. A heating/cooling medium such as water typically flows through the condenser and absorbs heat from the refrigerant to allow the compressed vapor refrigerant to condense. The liquid refrigerant exiting the condenser flows to the expansion valve. The expansion valve expands the refrigerant to cool the refrigerant. The refrigerant from the expansion valve flows to the evaporator. This refrigerant is often two-phase. The evaporator is a heat exchanger that allows the refrigerant to evaporate from liquid to vapor while absorbing heat from the heating/cooling medium passing through the evaporator. The refrigerant then returns to the compressor. The heating/cooling medium can be used to heat/cool the building. U.S. Patent Application Publication No. 2014/0127059 illustrates a typical system.

SUMMARY OF THE INVENTION

It has been discovered that in a condenser heat transfer performance can be improved by including as many heat transfer tubes as possible stacked up in the space available below the distribution area.

Therefore, one object of the present invention is to provide a condenser with a large number of tubes and excellent heat transfer performance.

It has been further discovered that if as many heat transfer tubes as possible are stacked up in the space available, the tubes may prevent the vapor around those tubes from flowing easily, which can cause a large pressure drop between the compressor outlet and the condenser tubes.

Therefore, another object of the present invention is to provide a condenser, in which vapor can flow around those tubes so that the vapor pressure drop between the compressor discharge and the condenser tubes can be reduced.

It has been further discovered that the tube layout can contribute to the pressure drop between the compressor discharge and the condenser tubes.

Therefore, another object of the present invention is to provide a tube layout of the heat transfer tubes in the condenser, which creates a flow passage to allow the vapor to flow down and reach the bottom tubes more easily by reducing pressure drop.

It has also been discovered that such a vapor pressure drop between the compressor discharge and the condenser tubes can be more prevalent in a case where a Low Pressure Refrigerant (LPR refrigerant) is used because a low pressure refrigerant may have a lower vapor density.

Therefore, yet another object of the present invention is to provide a condenser, in which vapor can flow around those tubes so that the vapor pressure drop between the compressor discharge and the condenser tubes can be reduced when LPR refrigerant is used.

One or more of the above objects can basically be attained by providing condenser adapted to be used in a vapor compression system. The condenser includes a shell and a tube bundle. The shell has a refrigerant inlet that at least refrigerant with gas refrigerant flows therethrough and a refrigerant outlet that at least refrigerant with liquid refrigerant flows therethrough, with a longitudinal center axis of the shell extending generally parallel to a horizontal plane. The tube bundle includes a plurality of heat transfer tubes disposed inside of the shell so that the refrigerant discharged from the refrigerant inlet is supplied onto the tube bundle. The heat transfer tubes extend generally parallel to the longitudinal center axis of the shell. The plurality of heat transfer tubes in the tube bundle are arranged to form a first vapor passage extending generally vertically along a first passage lengthwise direction through at least some of the heat transfer tubes of the tube bundle. The first vapor passage has a first minimum width measured perpendicularly relative to the first passage lengthwise direction and the longitudinal axis. The first minimum width is larger than a tube diameter of the heat transfer tubes of the tube bundle, and the first minimum width is smaller than four times the tube diameter.

These and other objects, features, aspects, and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
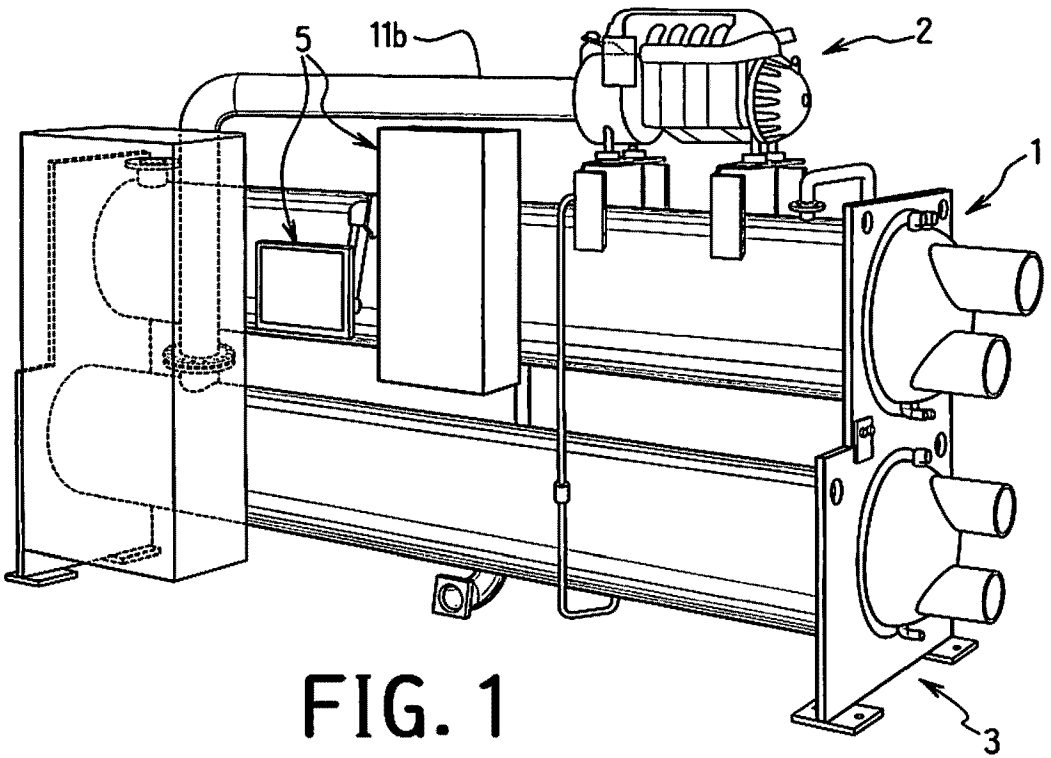
FIG. 1 is a simplified, overall perspective view of a vapor compression system including a condenser according to a first embodiment of the present invention.
Figure 2:
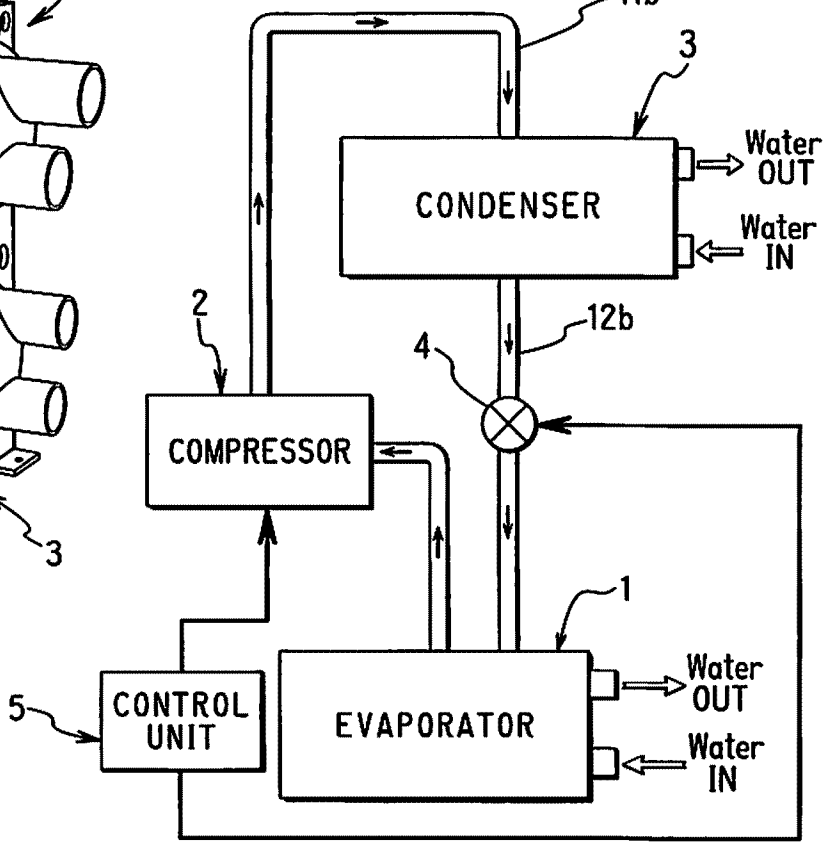
FIG. 2 is a block diagram illustrating a refrigeration circuit of the vapor compression system including the condenser according to the first embodiment of the present invention.

Referring initially to FIGS. 1 and 2, a vapor compression system including a condenser 3 according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene glycol, brine, etc.) via a vapor-compression refrigeration cycle, and to add heat to liquid to be heated (e.g., water, ethylene glycol, calcium chloride brine, etc.) via a vapor-compression refrigeration cycle. Water is shown in the illustrated embodiment. However, it will be apparent to those skilled in the art from this disclosure that other liquids can be used. Heating and cooling of the liquid is shown in the illustrated embodiment.

As shown in FIGS. 1 and 2, the vapor compression system includes the following main components: an evaporator 1, a compressor 2, the condenser 3, an expansion device 4, and a control unit 5. The control unit 5 is operatively coupled to a drive mechanism of the compressor 2 and the expansion device 4 to control operation of the vapor compression system. The control unit may also be connected to various other components such as sensors and/or optional components of the system not shown.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is typically in a two-phase gas/liquid state. The refrigerant at least includes liquid refrigerant. The liquid refrigerant evaporates as the vapor refrigerant in the evaporator 1 absorbs heat from the cooling medium such as water. In the illustrated embodiment, the evaporator 1 uses water as a heating/cooling medium as mentioned above. The evaporator 1 can be any one of numerous conventional evaporators, such as a falling film evaporator, flooded evaporator, hybrid evaporator, etc. The water exiting the evaporator is cooled. This cooled water can then be used to cool the building or the like.

Upon exiting the evaporator 1, the refrigerant will be low pressure low temperature vapor refrigerant. The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger, which removes heat from the vapor refrigerant causing it to condense from a gas state to a liquid state. The condenser 3 in the illustrated embodiment is liquid cooled using a liquid such as water. The heat of the compressed vapor refrigerant raises the temperature of cooling water passing through the condenser 3. Usually, the hot water from the condenser is routed to a cooling tower to reject the heat to the atmosphere. In addition, optionally, the heated water (cooling water that cools the refrigerant) can be used in a building as a hot water supply or to heat the building.

The condensed liquid refrigerant then enters the expansion device 4 where the refrigerant undergoes an abrupt reduction in pressure. The expansion device 4 may be as simple as an orifice plate or as complicated as an electronic modulating thermal expansion valve. Whether the expansion device 4 is connected to the control unit will depend on whether a controllable expansion device 4 is utilized. The abrupt pressure reduction usually results in partial expansion of the liquid refrigerant, and thus, the refrigerant entering the evaporator 1 is usually in a two-phase gas/liquid state.

Some examples of refrigerants used in the vapor compression system are hydrofluorocarbon (HFC) based refrigerants, for example, R410A, R407C, and R134a, hydrofluoro olefin (HFO), unsaturated HFC based refrigerant, for example, R1234ze, and R1234yf, and natural refrigerants, for example, R717 and R718. R1234ze, and R1234yf are mid density refrigerants with densities similar to R134a. R450A and R513A are mid pressure refrigerants that are also possible refrigerants. A so-called Low Pressure Refrigerant (LPR) R1233zd is also a suitable type of refrigerant. Low Pressure Refrigerant (LPR) R1233zd is sometimes referred to as Low Density Refrigerant (LDR) because R1233zd has a lower vapor density than the other refrigerants mentioned above. R1233zd has a density lower than R134a, R1234ze, and R1234yf, which are so-called mid density refrigerants. The density being discussed here is vapor density not liquid density because R1233zd has a slightly higher liquid density than R134A. While the embodiment(s) disclosed herein are useful with any type of refrigerant, the embodiment(s) disclosed herein are particularly useful when used with LPR such as R1233zd. R1233zd is not flammable. R134a is also not flammable. However, R1233zd has a global warming potential GWP<10. On the Other hand, R134a has a GWP of approximately 1300. Refrigerants R1234ze, and R1234yf are slightly flammable even though their GWP is less than 10 like R1233zd. Therefore, R1233zd is a desirable refrigerant due to these characteristics, non-flammable and low GWP.

Figure 12:
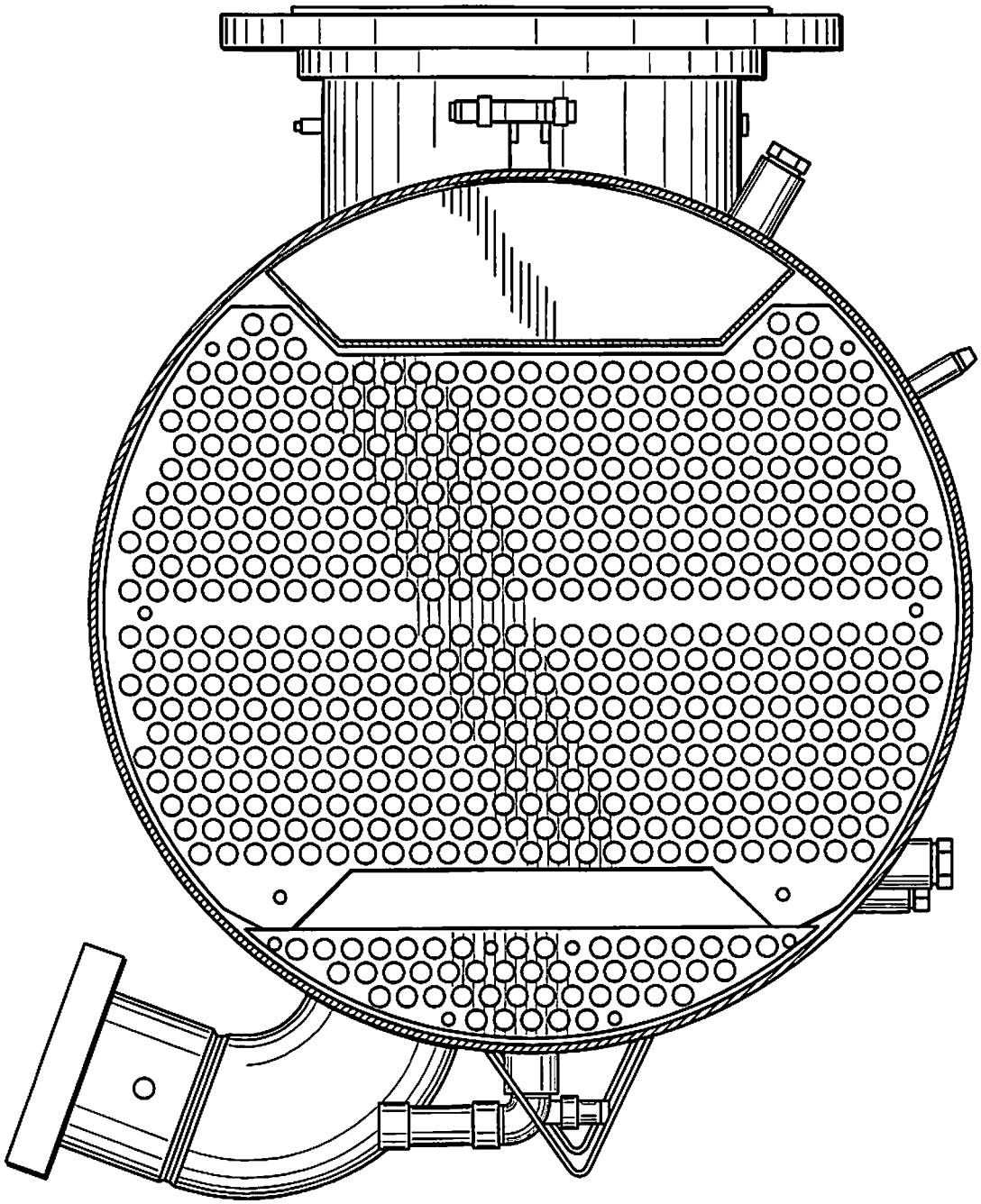
FIG. 12 is a simplified transverse cross sectional view of a condenser in which a number of tubes is maximized but a flow path is not provided.

While individual refrigerants are mentioned above, it will be apparent to those skilled in the art from this disclosure that a blended refrigerant utilizing any two or more of the above refrigerants may be used. For example, a blended refrigerant including only a portion as R1233zd could be utilized. In any case, in the illustrated embodiment, the refrigerant preferably includes R1233zd. More preferably, in the illustrated embodiment, the refrigerant preferably is R1233zd. As mentioned above, R1233zd is a desirable refrigerant due to its low GWP and not being flammable. However, in a condenser in which a maximum number of heat transfer tubes are included (to try to maximize efficiency) as shown in FIG. 12, it has been discovered that a relatively large pressure drop occurs because the tubes may prevent the vapor around those tubes from flowing easily, which can cause a large pressure drop between the compressor outlet and the condenser tubes. A relatively large pressure drop decreases cycle efficiency, and thus, it has been discovered that it is desirable to reduce the pressure drop. If vapor can flow around the tubes, the vapor pressure drop between the compressor discharge and the condenser tubes can be reduced, and thus cycle efficiency will not be reduced (cycle efficiency can be generally maintained).

It will be apparent to those skilled in the art from this disclosure that conventional compressor, evaporator and expansion device may be used respectively as the compressor 2, the evaporator 1 and the expansion device 4 in order to carry out the present invention. In other words, the compressor 2, the evaporator 1 and the expansion device 4 are conventional components that are well known in the art. Since the compressor 2, the evaporator 1 and the expansion device 4 are well known in the art, these structures will not be discussed or illustrated in detail herein. Rather, it will be apparent to those skilled in the art from this disclosure that any suitable compressor, evaporator and expansion device can be used with the condenser of the illustrated embodiment. Therefore, the following descriptions will focus on the condenser 3 in accordance with the present invention. In addition, it will be apparent to those skilled in the art from this disclosure that the vapor compression system may include a plurality of evaporators 1, compressors 2 and/or condensers 3 without departing the form the scope of the present invention.

Referring now to FIGS. 3-8, the detailed structure of the condenser 3 according to the first embodiment will be explained. The condenser 3 basically includes a shell 10, a refrigerant distributor 20, and a heat transferring unit 30. In the illustrated embodiment, the heat transferring unit 30 is a tube bundle. Thus, the heat transferring unit 30 will also be referred to as the tube bundle 30 herein. As mentioned above, in the illustrated embodiment, the tube bundle 30 carries a liquid cooling/heating medium such as water therethrough.

Refrigerant enters the shell 10 and is supplied to the refrigerant distributor 20. The refrigerant distributor 20 is configured to relatively evenly distribute the refrigerant onto the tube bundle 30, as explained in more detail below. The refrigerant entering the shell 10 of the condenser 3 is a compressed gas (vapor) refrigerant that is typically at high pressure and high temperature. The vapor refrigerant will exit the distributor 20 and flow into the interior of the shell 10 onto the tube bundle 30. The vapor refrigerant will gradually cool and condense as it flows down over the tube bundle 30. The medium (water) in the tube bundle 30 absorbs heat from the vapor refrigerant to cause this condensation and cooling to occur. The condensed liquid refrigerant will then exit the bottom of the condenser, as explained in more detail below.

Figure 3:
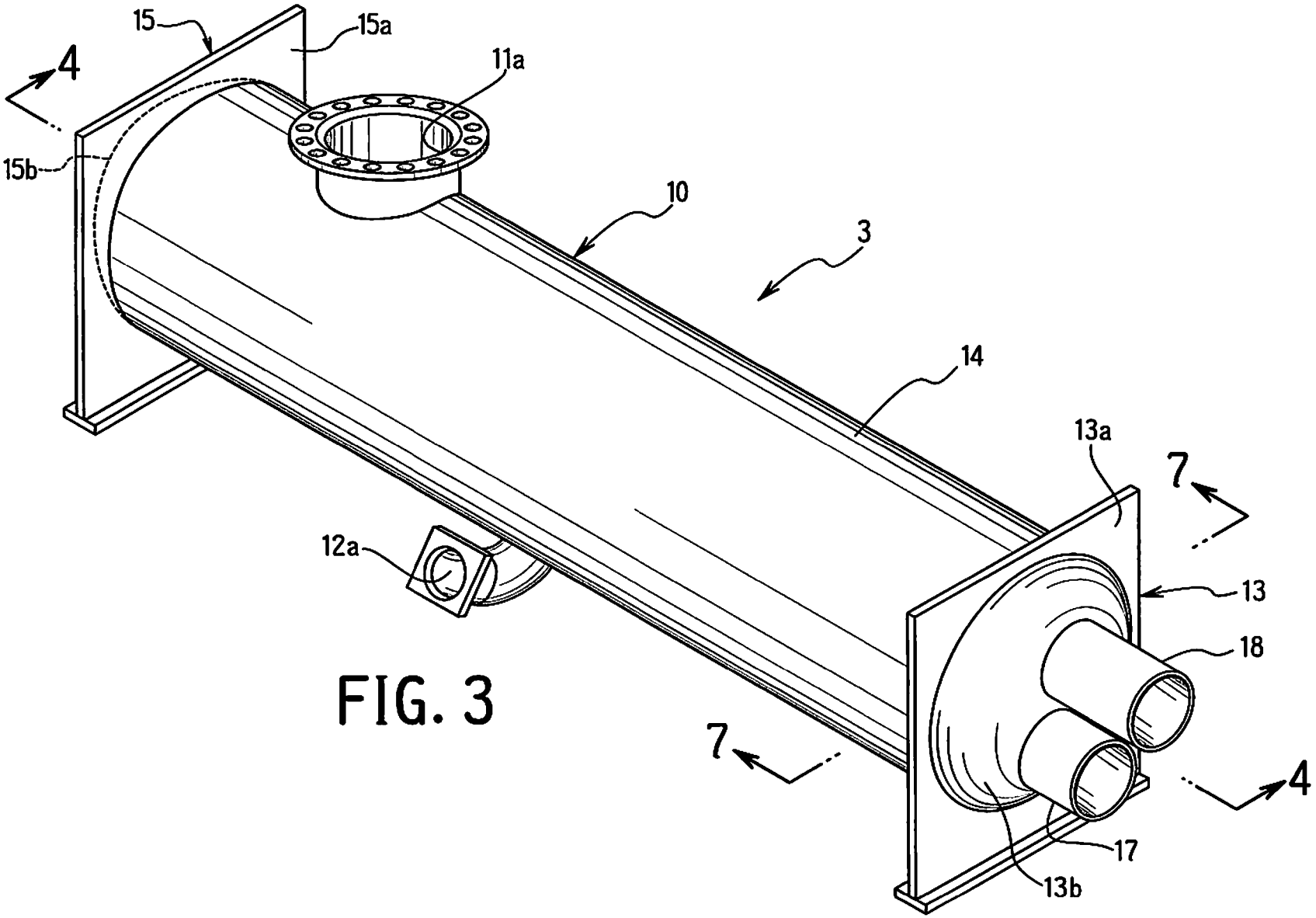
FIG. 3 is a simplified perspective view of the condenser according to the first embodiment of the present invention.
Figure 4:
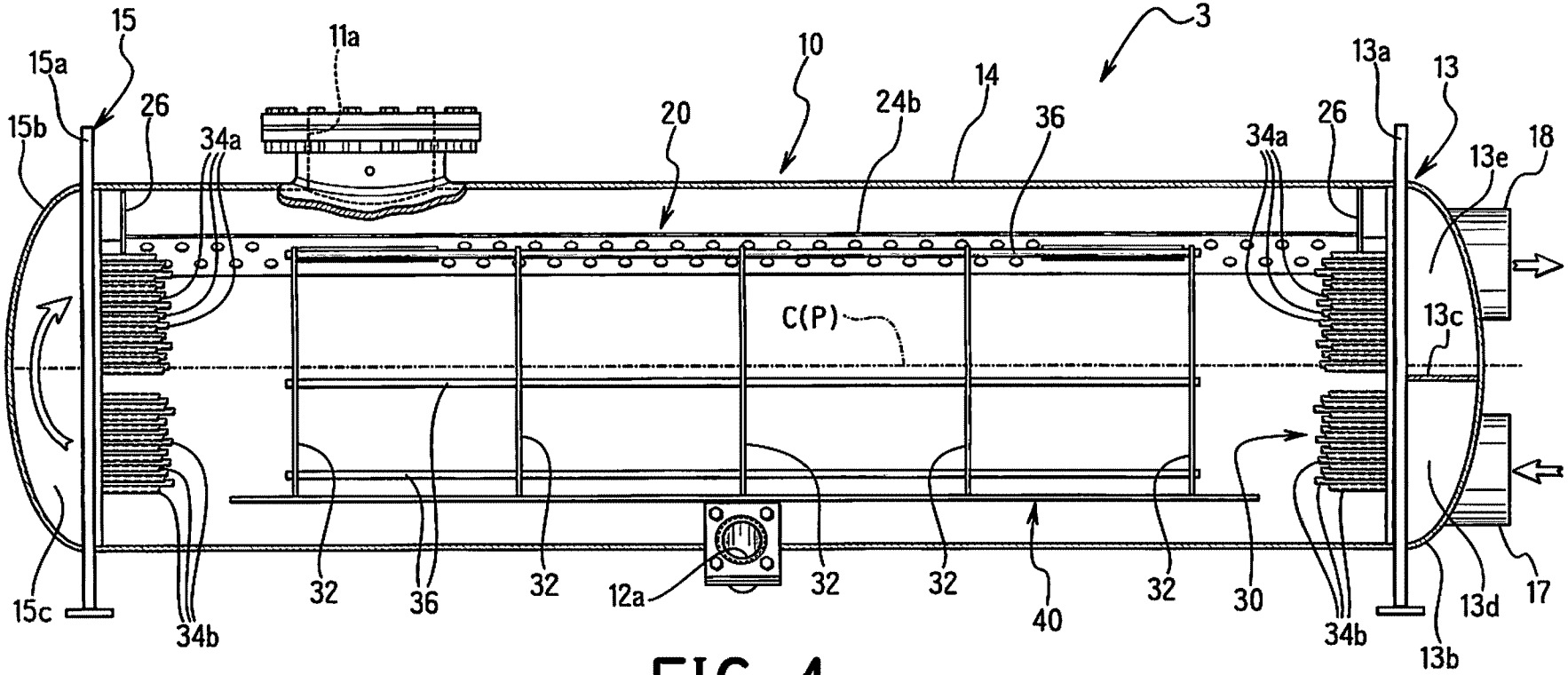
FIG. 4 is a simplified longitudinal cross sectional view of the condenser illustrated in FIGS. 1-3, with tubes broken away for the purpose of illustration, as seen along section line 4-4 in FIG. 3.
Figure 5:
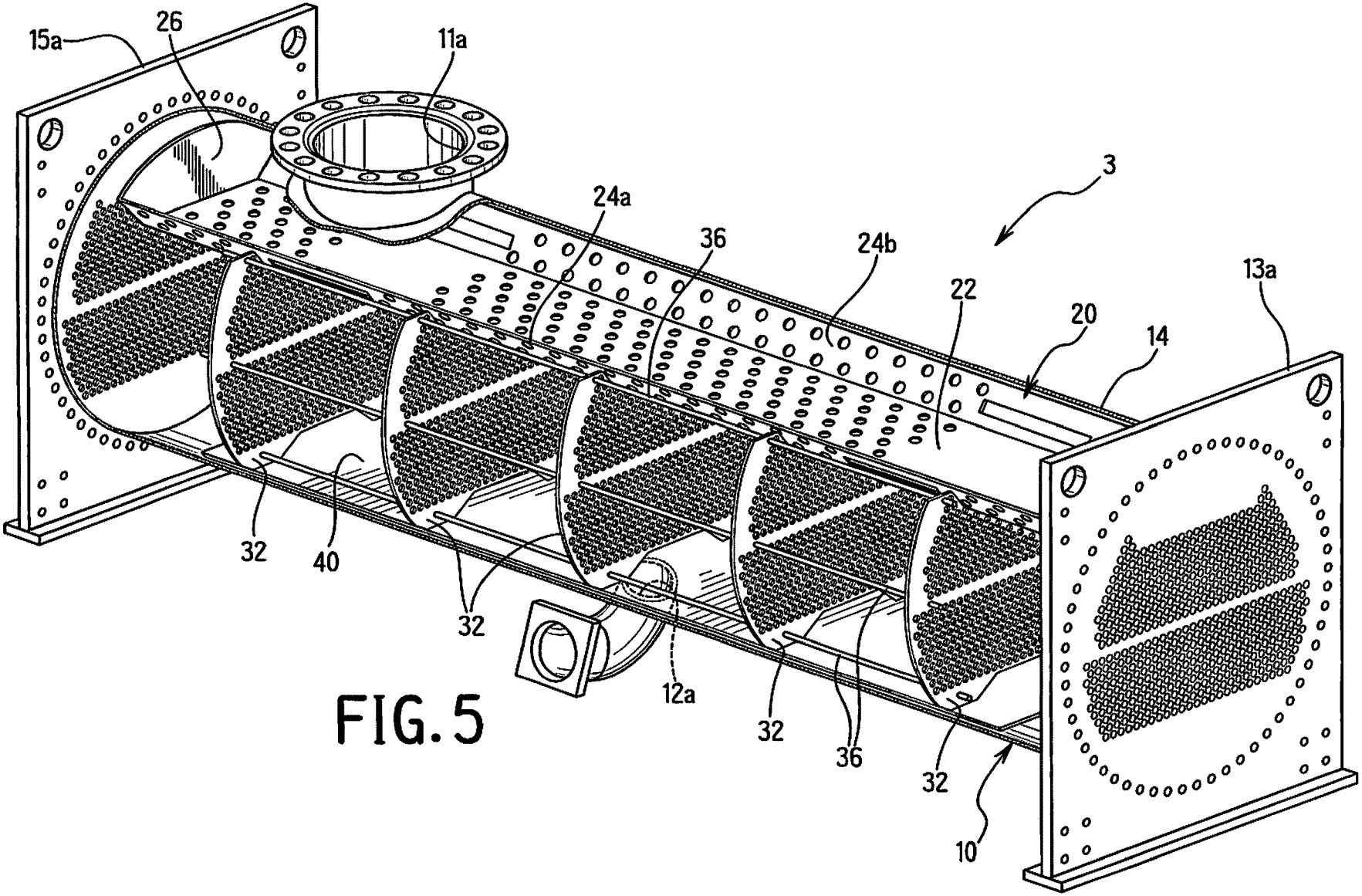
FIG. 5 is a simplified perspective view of an internal structure of the condenser illustrated in FIGS. 1-4, but with the heat transfer tubes removed for the purpose of illustration.

As best understood from FIGS. 3-5, in the illustrated embodiment, the shell 10 has a generally cylindrical shape with a longitudinal center axis C (FIG. 4) extending generally in the horizontal direction. Thus, the shell 10 extends generally parallel to a horizontal plane P and the center axis C is generally parallel to the horizontal plane P. The shell 10 includes a connection head member 13, a cylindrical body 14, and a return head member 15. The cylindrical body 14 is hermetically attached between the connection head member 13 and the return head member 15. Specifically, the connection head member 13 and the return head member 15 are hermetically fixedly coupled to longitudinal ends of the cylindrical body 14 of the shell 10.

The connection head member 13 includes an attachment plate 13*a*, a dome part 13*b* attached to the attachment plate 13*a* and a divider plate 13*c* extending between the attachment plate 13*a* and the dome part 13*b* to define an inlet chamber 13*d* and an outlet chamber 13*e*. The attachment plate 13*a* is normally a tube sheet that is normally welded to the cylindrical body 14. The dome part 13*b* is normally attached to the tube sheet (attachment plate) 13*a* using bolts and a gasket (not shown) disposed therebetween. The divider plate 13*c* is normally welded to the dome part 13*b*. The inlet chamber 13*d* and the outlet chamber 13*e* are divided from each other by the divider plate 13*c*. The return head member 15 also includes an attachment plate 15*a* and a dome member 15*b* attached to the attachment plate 15*a* to define a return chamber 15*c*. The attachment plate 15*a* is normally a tube sheet that is normally welded to the cylindrical body 14. The dome part 15*b* is normally attached to the tube sheet (attachment plate) 15*a* using bolts and a gasket (not shown) disposed therebetween. The return head member 15 does not include a divider. Thus, the attachment plates 13*a* and 15*a* are fixedly coupled to longitudinal ends of the cylindrical body 14 of the shell 10. The inlet chamber 13*d* and the outlet chamber 13*e* are partitioned by the divider plate (baffle) 13*c* to separate flow of the cooling medium. Specifically, the connection head member 13 is fluidly connected to both an inlet pipe 17 through which water enters and a water outlet pipe 18 through which the water is discharged from the shell 10. More specifically, the inlet chamber 13*d* is fluidly connected to the inlet pipe 17, and the outlet chamber 13*e* is fluidly connected to the outlet pipe 18, with the divider plate 13*c* dividing the flows.

The attachment plates 13*a* and 15*a* include a plurality of holes with heat transfer tubes 34*a* and 34*b* mounted therein. The tubes 34*a* form an upper group of heat transfer tubes while the tubes 34*b* form a lower group of heat transfer tubes. For example, the heat transfer tubes 34*a* and 34*b* can be positioned in the holes and then roller expanded to secure the tubes 34*a* and 34*b* within the holes and form a seal therebetween. A lower group of the heat transfer tubes 34*b* receive water from the inlet chamber 13*d* and carry the water through the cylindrical body 14 to the return chamber 15*c*. The water in the return chamber 15*c* then flows into an upper group of the heat transfer tubes 34*a* back through the cylindrical body 14 and into the outlet chamber 13*e*. Thus, in the illustrated embodiment, the condenser 3 is a so-called "two pass" condenser 3. The flow path of the water is sealed from an interior space of the cylindrical body 14 between the attachment plates 13*a* and 15*a*. This interior space contains refrigerant sealed from the water flow path. Thus, the tube bundle 30 includes an upper group of the heat transfer tubes 34*a* and a lower group of the heat transfer tubes 34*b* disposed below the upper group of the heat transfer tubes 34*a*.

In the illustrated embodiment, the upper group of the heat transfer tubes 34*a* is disposed at or above a vertical middle plane (e.g., the plane P in FIG. 4) of the shell 10, and the lower group of the heat transfer tubes 34*b* is disposed at or below the vertical middle plane (e.g., the plane P in FIG. 4) of the shell 10. More specifically, in the illustrated embodiment, the upper group of the heat transfer tubes 34*a* is disposed at and above a vertical middle plane (e.g., the plane P in FIG. 4) of the shell 10, and the lower group of the heat transfer tubes 34*b* is disposed below the vertical middle plane (e.g., the plane P in FIG. 4) of the shell 10. In the illustrated embodiment, the upper and lower groups are separated by a gap and have approximately (or generally) the same number of heat transfer tubes 34*a* and 34*b* in each group (e.g. within a few percent) so that water can flow in generally the same manner (e.g., velocity/volume) through the upper and lower groups of the heat transfer tubes 34*a* and 34*b*. However, it is not necessary for an exact match between the tube counts of the heat transfer tubes 34*a* and 34*b*. Rather, it will be apparent to those skilled in the art from this disclosure that the tube counts of the heat transfer tubes 34*a* and 34*b* can be selected to be close enough to each other so that adverse water flow issues do not occur.

The shell 10 further includes a refrigerant inlet 11*a* connected to a refrigerant inlet pipe 11*b* and a refrigerant outlet 12*a* connected to a refrigerant outlet pipe 12*b*. The refrigerant inlet pipe 11*b* is fluidly connected to the compressor 2 to introduce compressed vapor gas refrigerant supplied from the compressor 2 into the top of the shell 10. From the refrigerant inlet 11*a* the refrigerant flows into the refrigerant distributor 20, which distributes the refrigerant over the tube bundle 30. The refrigerant condenses due to heat exchange with the tube bundle 30. Once condensed within the shell 10, liquid refrigerant exits the shell 10 through the refrigerant outlet 12*a* and flows into the refrigerant outlet pipe 12*b*. The expansion device 4 is fluidly coupled to the refrigerant outlet pipe 12*b* to receive the liquid refrigerant. The refrigerant that enters the refrigerant inlet 11*a* includes at least gas refrigerant. The refrigerant that flows through the refrigerant outlet 12*a* includes at least liquid refrigerant. Thus, the shell 10 has a refrigerant inlet 11*a* that at least refrigerant with gas refrigerant flows therethrough and a refrigerant outlet 12*a* that at least refrigerant with liquid refrigerant flows therethrough, with a longitudinal center axis C of the shell extending generally parallel to the horizontal plane P.

Figure 6:
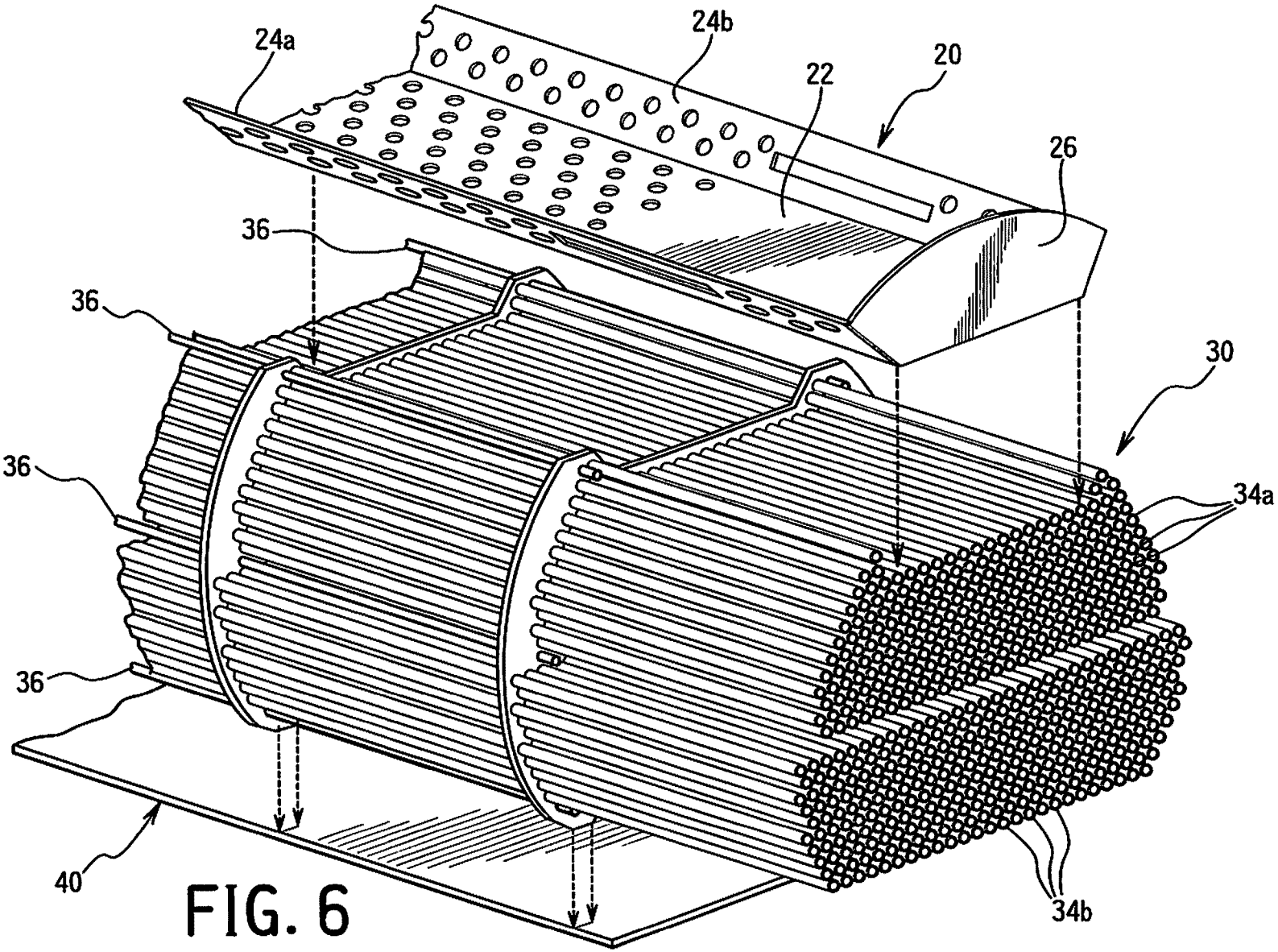
FIG. 6 is an enlarged, simplified, exploded partial perspective view of an internal structure of the condenser, i.e., the tubes, supports, and diffuser, illustrated in FIGS. 1-5.

Referring now to FIGS. 4-8, the refrigerant distributor 20 is fluidly connected to the refrigerant inlet 11*a* and is disposed within the shell 10. The refrigerant distributor 20 is arranged and configured with a dish configuration to receive the refrigerant entering the shell 10 through the refrigerant inlet 11*a*. The refrigerant distributor 20 extends longitudinally within the shell 10 generally parallel to the longitudinal center axis C of the shell 10. As best shown in FIGS. 4-6, the refrigerant distributor 20 includes a base part 22, a first side part 24*a*, a second side part 24*b*, and a pair of end parts 26. The base part 22, first side part 24*a*, the second side part 24*b*, and the pair of end parts 26 are rigidly connected together. In the illustrated embodiment, each of the base part 22, first side part 24*a*, the second side part 24*b*, and the pair of end parts 26 is constructed of thin rigid plate material such as steel sheet material. In the illustrated embodiment, the base part 22, first side part 24*a*, the second side part 24*b*, and the pair of end parts 26 can be constructed as separate parts fixed to each other or can be integrally formed as a one-piece unitary member.

In the illustrated embodiment, a plurality of holes are formed in the base part 22, first side part 24*a*, and the second side part 24*b*. On the other hand, the end parts 26 are free of holes. In the illustrated embodiment, the base part 22 has circular holes formed therein except at end areas as best understood from FIG. 5. Likewise, in the illustrated embodiment, the side parts 24*a* and 24*b* have circular holes formed therein, except at end areas. At the end areas of the side parts 24*a* and 24*b*, however, unlike the base part 22, longitudinal slots are formed. The longitudinal ends beyond the end areas have holes formed therein like the middle areas. It will be apparent to those skilled in the art from this disclosure that the pattern and shape of holes illustrated herein represent one example of a suitable distributor 20 in accordance with the present invention.

In the illustrated embodiment, the distributor 20 is welded to the upper portion of the shell 10. Alternatively and/or in addition, the distributor 20 may be fixed to support plates (discussed below) of the tube bundle 30. However, this is not necessary in the illustrated embodiment. In addition, it will be apparent to those skilled in the art from this disclosure that the end parts 26 may be omitted if not needed and/or desired. In the illustrated embodiment, the end parts 26 of the distributor 20 are present and have upper ends with curves matching an internal curvature of the cylindrical shape of the cylindrical body 14 shell 10. When the distributor 20 is fixed to the shell 10, upper edges of the side parts 24*a* and 24*b* and/or upper edges of the end parts 26 can be attached to the curved internal surface using any suitable conventional technique. Welding is one example. In the illustrated embodiment, the distributor 20 has a length almost as long as an internal length of the shell 10. Specifically, in the illustrated embodiment, the distributor has a length at least about 90% as long as an internal length of the shell 10, e.g., about 95%. Thus, refrigerant is distributed from the distributor 20 along almost an entire length of the tube bundle 30.

Referring again to FIGS. 4-8, the heat transferring unit 30 (tube bundle) will now be explained in more detail. The tube bundle 30 is disposed below the refrigerant distributor 20 so that the refrigerant discharged from the refrigerant distributor 20 is supplied onto the tube bundle 30. The tube bundle 30 includes a plurality of support plates 32, a plurality of heat transfer tubes 34*a* and 34*b* (mentioned briefly above) that extend generally parallel to the longitudinal center axis C of the shell 10 through the support plates 32, and a plurality of plate support members 36, as best shown in FIGS. 4-6. In addition, a guide plate 40 is disposed below the tube bundle 30. The guide plate 40 collects condensed liquid (refrigerant) and directs that liquid to the condenser outlet 12*a* at the bottom of the shell 10.

The support plates 32 are shaped to partially match an interior shape of the shell 10 to be fitted therein. The guide plate 40 is disposed under the support plates 32. The heat transfer tubes 34*a* and 34*b* extend through holes formed in the support plates 32 so as to be supported by the support plates 32 within the shell 10. The plate support members 36 are attached to the support plates 32 to support and maintain the support plates 32 in the spaced arrangement relative to each other, as shown in FIGS. 4-5. Once the support plates 32 and plate support members 36 are attached together as a unit (e.g., by welding), the unit can be inserted into the cylindrical body 14 and can be attached thereto, as explained below in more detail.

Referring still to FIGS. 4-8, the support plates 32 are identical to each other. Each support plate 32 is preferably formed of a rigid sheet material such as sheet metal. Thus, each support plate 32 has a flat plate shape and includes curved sides shaped to match an interior curvature of the shell, and upper and lower notches extending generally toward each other. Due to the mating curved shapes of the support plates 32 and the cylindrical body 14 the support plates 32 are prevented from moving vertically, laterally, etc. (e.g., in any direction transverse to the longitudinal center axis C) relative to the cylindrical body 14. The guide plate 40 is disposed under the support plates 32. The guide plate 40 can be fixed to the cylindrical body 14 or may merely rest inside the cylindrical body 14. Likewise, the guide plate 40 may be fixed to the support plates 32 or the support plates may merely rest on the guide plate 40. In the illustrated embodiment, the guide plate 40 is fixed (e.g., welded) to the cylindrical body 14 before assembly of the support plates 32 and the plate support members 36 is inserted and attached to the cylindrical body 14. In the illustrated embodiment, once the assembly of the support plates 32 and the plate support members 36 are attached together (e.g., by welding), the assembly is inserted into the cylindrical body 14 on top of the guide plate 40, and then the end ones of the support plates 32 are welded to the cylindrical body 14 of the shell 10.

The upper notches of the support plates 32 form a recess shaped to make space for the distributor 20. As mentioned above, the distributor 20 is welded to the cylindrical body 14 such that the distributor 20 is disposed within the upper notches. Of course, alternatively, it will be apparent to those skilled in the art from this disclosure that the distributor 20 may be fixed to the support plates 32 or the distributor 20 may rest on the support plates 32. In the illustrated embodiment, the support plates 32 are not fixed to the distributor 20 so that the distributor 20 can be attached to the cylindrical body 14 before or after the tube bundle 30 as a unit. The lower notches of the support plates 32 together form a fluid flow channel. The guide plate 40 is mounted within the shell 10 to extend parallel to the longitudinal center axis C and parallel to the plane P under the support plates 32 as mentioned above. As the compressed vapor refrigerant supplied to the tube bundle 30 from the distributor 20 descends over the tube bundle 30, the refrigerant condenses and changes state into liquid refrigerant. This condensed liquid refrigerant flows along the guide plate 40 toward the ends of the condenser 3. The guide plate 40 is shorter than the cylindrical body 14. Thus, the liquid refrigerant then flows downward and then along the bottom of the cylindrical body 14 to the refrigerant outlet 12*a*.

Referring still to FIGS. 4-8, the support plates 32 have a plurality of holes formed therein. Almost all of the holes receive heat transfer tubes 34*a* and 34*b* therethrough. However, a few of the holes receive the plate support members 36. In the illustrated embodiment, six of the holes receive these members 36. Specifically, on each side of the tube bundle, in the illustrated embodiment, three of the plate support members 36 extend through holes in the support plates 32 and are fixed to the support plates 32 to maintain the support plates 32 in the spaced arrangement illustrated herein. The guide plate 40 can further provide vertical support to the bottom of the tube bundle 30, as best understood from FIGS. 5-6. In the illustrated embodiment, the plate support members 36 are constructed as elongated, rigid, rod-shaped members. One suitable material is steel.

The heat transfer tubes 34*a* and 34*b* extend through the remaining holes of the support plates 32 so as to be supported by the support plates 32 in the pattern illustrated herein. The heat transfer tubes 34*a* and 34*b* may be fixed to the support plates 32 or merely supported by the support plates 32. In the illustrated embodiment, the heat transfer tubes 34*a* and 34*b* only rest on and are not fixed to the support plates 32. In the illustrated embodiment, the plate support members 36 have diameters smaller than diameters of the heat transfer tubes 34*a* and 34*b*. In the illustrated embodiment, the plate support members 36, and the heat transfer tubes 34*a* and 34*b* have circular cross-sectional shapes. Because the diameters of the plate support members 36 are smaller than the heat transfer tubes 34*a* and 34*b*, even though the plate support members 36 are mounted to the outer sides of the support plates 32 vapor flow passages can be created, which are not significantly hindered by the presence of the plate support members 36. This will be explained in more detail below.

The heat transfer tubes 34*a* and 34*b* are made of materials having high thermal conductivity, such as metal. The heat transfer tubes 34*a* and 34*b* are preferably provided with interior and exterior grooves to further promote heat exchange between the refrigerant and the water flowing inside the heat transfer tubes 34*a* and 34*b*. Such heat transfer tubes including the interior and exterior grooves are well known in the art. For example, GEWA-C tubes by Wieland Copper Products, LLC may be used as the heat transfer tubes 34*a* and 34*b* of this embodiment. As mentioned above, the heat transfer tubes 34*a* and 34*b* are supported by the plurality of vertically extending support plates 32, which are supported within the shell 10.

As mentioned above, in this embodiment, the tube bundle 30 is arranged to form a two-pass system, in which the heat transfer tubes 34*a* and 34*b* are divided into a supply line group of tubes 34*b* disposed in a lower portion of the tube bundle 30, and a return line group of tubes 34*a* disposed in an upper portion of the tube bundle 30. As shown in FIG. 4, inlet ends of the heat transfer tubes 34*b* in the supply line group are fluidly connected to the inlet pipe 17 via the inlet chamber 13*d* of the connection head member 13 so that water entering the condenser 3 is distributed into the heat transfer tubes 34*b* in the supply line group. Outlet ends of the heat transfer tubes 34*b* in the supply line group and inlet ends of the heat transfer tubes 34*a* of the return line group are fluidly communicated with the return chamber 15*c* of the return head member 15. Therefore, the water flowing inside the heat transfer tubes 34*b* in the supply line group is discharged into the return chamber 15*c*, and redistributed into the heat transfer tubes 34*a* in the return line group. Outlet ends of the heat transfer tubes 34*a* in the return line group are fluidly communicated with the outlet pipe 18 via the outlet chamber 13*e* of the connection head member 13. Thus, the water flowing inside the heat transfer tubes 34*a* in the return line group exits the condenser 3 through the outlet pipe 18.

Although, in this embodiment of FIGS. 1-8, there are no heat transfer tubes disposed under the guide plate 40 (i.e., there is no sub-cooler below the guide plate 40), it will be apparent to those skilled in the art from this disclosure that the supply line group may include an additional group of plates and tubes under the guide plate 40 (i.e., a sub-cooler below the guide plate 40), such as is illustrated in FIG. 12. With such an arrangement, communicating holes should be formed at the bottom of the plates under the guide plate 40 or cutouts should be formed so that liquid refrigerant can flow along the bottom of the condenser to the refrigerant outlet 12*a*. Refrigerant should already be liquid once the refrigerant has descended to the guide plate 40. Thus, additional heat transfer tubes under the guide plate 40 can be used in order to further lower the temperature of the liquid under the guide plate 40 (i.e., to sub-cool) before exiting the condenser. In addition, it will be apparent to those skilled in the art from this disclosure, that an additional outlet from the condenser 3 can be provided if a supply of condensed liquid refrigerant is needed for some other purpose (e.g., for motor cooling or any other purpose). Such an additional outlet from the condenser is shown in FIG. 12.

Referring to still FIGS. 4-8, assembly of the condenser 3 will now be explained in more detail. The plate support members 36 are attached to the support plates 32 (e.g., by welding) to form a tube bundle unit. The guide plate 40 can be inserted in and fixed (e.g., welded) to the shell 10 before or after assembly of the support plates 32 and the plate support members 36. Similarly, the distributor 20 can be inserted in and fixed (e.g., welded) to the shell 10 before or after assembly of the support plates 32 and the plate support members 36. In any case the assembled tube bundle unit including the support plates 32 and the plate support members 36 is inserted into the cylindrical body 14, after attaching the distributor 20 and the guide plate 40 in the illustrated embodiment. The end pieces of the support plates 32 are then fixed (e.g., welded) to the cylindrical body 14. Next, the tube sheets 13*a* and 15*a* are attached (e.g., by welding) to the cylindrical body 14. Next the heat transfer tubes 34*a* and 34*b* are inserted through the holes in the tube sheets 13*a* and 15*a* and through the support plates 32. The heat transfer tubes 34*a* and 34*b* can then be roller expanded into the tube sheets 13*a* and 15*a* to secure the heat transfer tubes 34*a* and 34*b*. This is merely one example of how the condenser of the illustrated embodiment can be assembled. However, it will be apparent to those skilled in the art from this disclosure that other assembly techniques and/or orders of insertion and attachment are possible without departing from the scope of the instant application.

Figure 7:
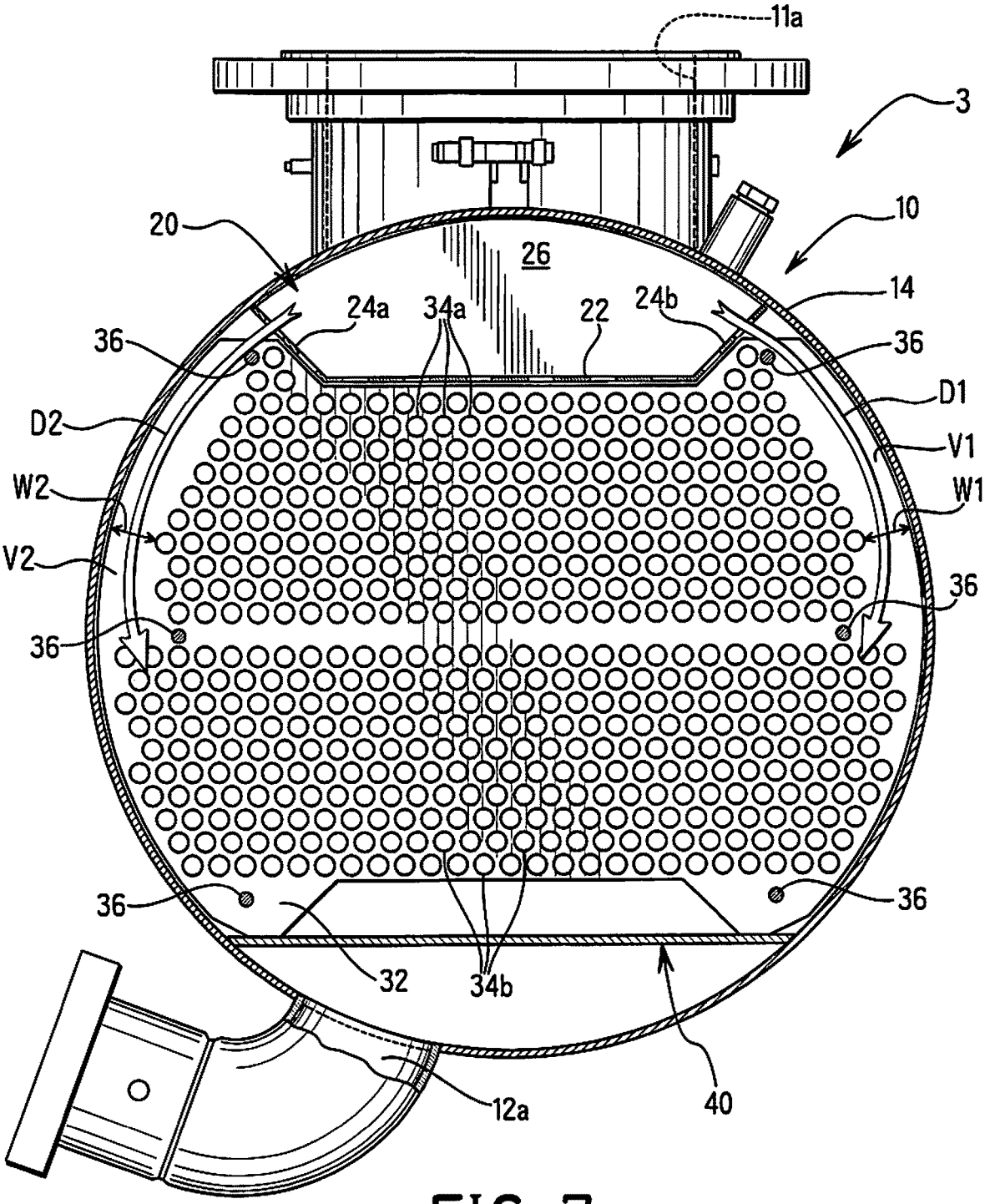
FIG. 7 is a simplified transverse cross sectional view of the condenser illustrated in FIGS. 1-6, as seen along section line 7-7 in FIG. 3.
Figure 8:
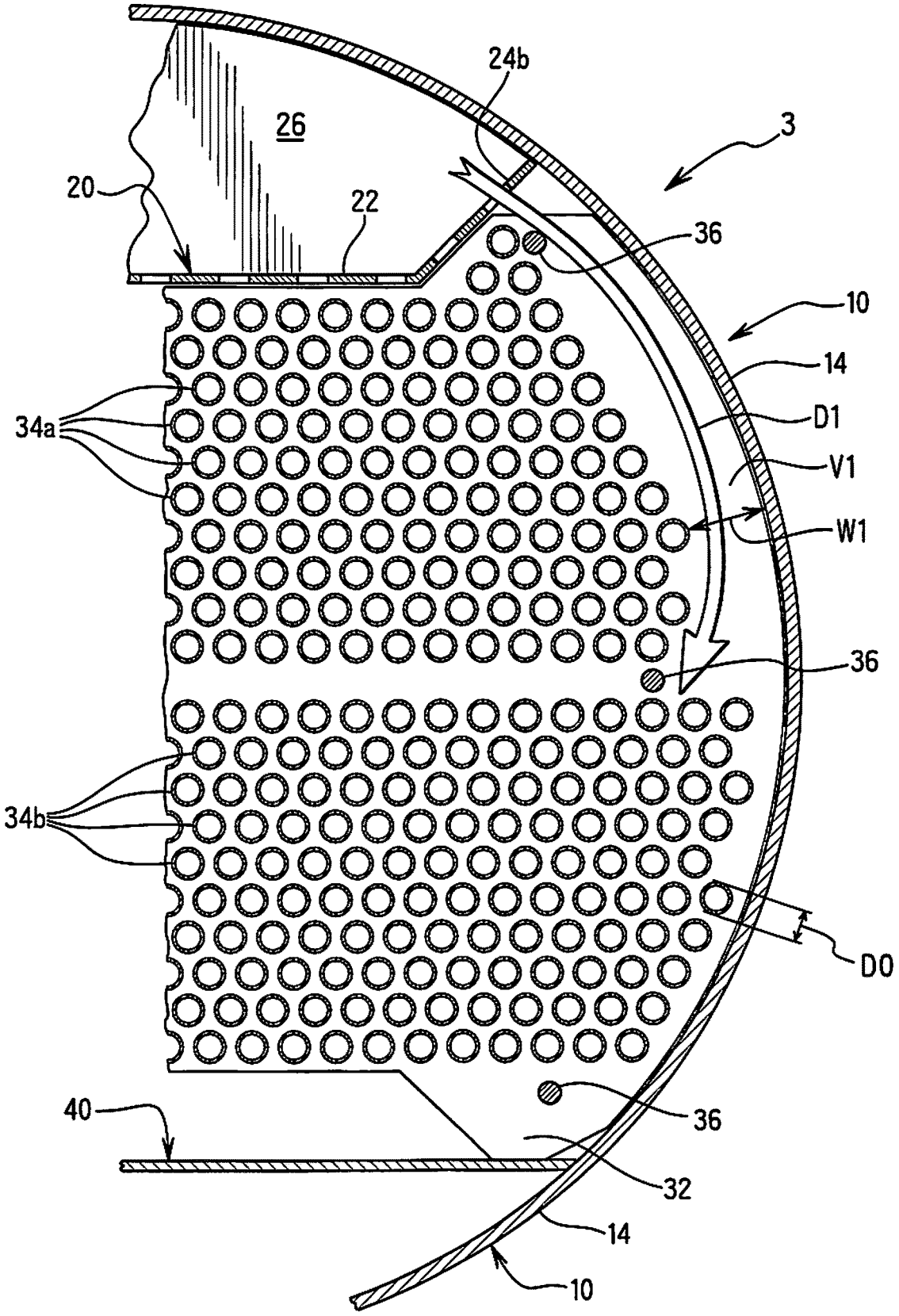
FIG. 8 is a further enlarged view of the right side of the condenser illustrated in FIG. 7.

More detailed arrangement for a heat transfer mechanism of the condenser 3 according to the illustrated embodiment will now be explained with reference to FIGS. 7-8. As mentioned above, the tube bundle 30 includes the plurality of heat transfer tubes 34*a* and 34*b* disposed inside of the shell 10 so that the refrigerant discharged from the refrigerant inlet 11*a* is supplied onto the tube bundle 30, with the heat transfer tubes 34*a* and 34*b* extending generally parallel to the longitudinal center axis C of the shell. In the illustrated embodiment, the plurality of heat transfer tubes 34*a* in the tube bundle are arranged to form at least a first vapor passage V1 extending generally vertically along a first passage lengthwise direction D1 through at least some of the heat transfer tubes 34*a* of the tube bundle 30. In addition, in the illustrated embodiment, the plurality of heat transfer tubes 34*a* in the tube bundle are arranged to form a second vapor passage V2 extending generally vertically along a second passage lengthwise direction D2 through at least some of the heat transfer tubes 34*a* of the tube bundle 30. Thus, in the illustrated a pair of vapor passages V1 and V2 are provided.

The vapor passages V1 and V2 are provided in order to reduce a pressure drop, which in turn limits reduction in cycle efficiency (cycle efficiency can be generally maintained). In this embodiment, the vapor passages V1 and V2 are provided through the upper group of heat transfer tubes 34*a* but not through the lower group of heat transfer tubes 34*b*. However, it will be apparent to those skilled in the art from this disclosure that the vapor passages V1 and V2 can also extend through the lower group of heat transfer tubes 34*b* (in addition to the upper group of heat transfer tubes 34*a*). In any case, the vapor passages V1 and V2 at least extend through the upper group of heat transfer tubes 34*a* as illustrated in this embodiment. This is because as refrigerant descends further downward in the condenser 3, more of the refrigerant condenses to liquid. As the amount of liquid increases the amount of refrigerant vapor decreases. As the amount of refrigerant vapor decreases the benefit(s) obtained by the vapor passages V1 and V2 may diminish. This is why the vapor passages V1 and V2 are provided at least through the upper group of heat transfer tubes 34*a* where there is a higher concentration of vapor than in the lower group of the heat transfer tubes 34*b*.

The vapor passage V1 has a first minimum width W1 measured perpendicularly relative to the first passage lengthwise direction D1 and the longitudinal axis C. The first minimum width W1 is larger than a tube diameter DO of the heat transfer tubes of the tube bundle 30, and the first minimum width W1 is smaller than four times the tube diameter DO. As best understood from FIGS. 7-8, minimum gaps between the heat transfer tubes 34*b* in the lower group and the shell 10 are smaller than tube diameter DO. Thus, even though some vapor can flow through these gaps, these gaps are not considered parts of the first and second vapor passages V1 and V2. In other words, as used herein a vapor passage is intended to mean a gap or width W1 or W2 at least as large as the tube diameter DO and smaller than four times the tube diameter DO.

In the illustrated embodiment, the first minimum width W1 is larger than twice the tube diameter DO and smaller than three times the tube diameter. In the illustrated embodiment, the first minimum width W1 is about 2.5 times the tube diameter DO. Gaps between the remaining tubes 34*a* in the upper group are larger than W1, e.g., ranging from between slightly less than three times the tube diameter DO to slightly less than four times the tube diameter DO (bottom row tube and $3^{rd}$ from the bottom row tube of the upper group). Likewise, in the illustrated embodiment, the second minimum width W2 is larger than twice the tube diameter DO. In the illustrated embodiment, the vapor passages V1 and V2 are mirror images of each other, and thus, it will be apparent to those skilled in the art from this disclosure that that descriptions/illustrations of one side also apply to the other side. Moreover, it will be apparent to those skilled in the art from this disclosure that this embodiment is merely one example, and that the upper part of the condenser 3 could be replaced with the upper part of the condenser of the second embodiment, discussed below, and vice versa.

In the illustrated embodiment, the first vapor passage V1 is formed between the tube bundle 30 and a first longitudinal sidewall (e.g., a first lateral side of the cylindrical body 14) of the shell 10. Likewise, in the illustrated embodiment, the second vapor passage V2 is formed between the tube bundle 30 and a second longitudinal sidewall (e.g., a second opposite lateral side of the cylindrical body 14) of the shell 10. This can best be seen in FIG. 7. In the illustrated embodiment, the first and second lengthwise directions D1 and D2 are arc-shaped and extend along an interior of the cylindrical body 14. Thus, in the illustrated embodiment, the first and second vapor passages V1 and V2 are formed between the upper group of heat transfer tubes 34*a* and the cylindrical body 14 (opposing first and second longitudinal sidewalls) of the shell 10.

Figure 11:
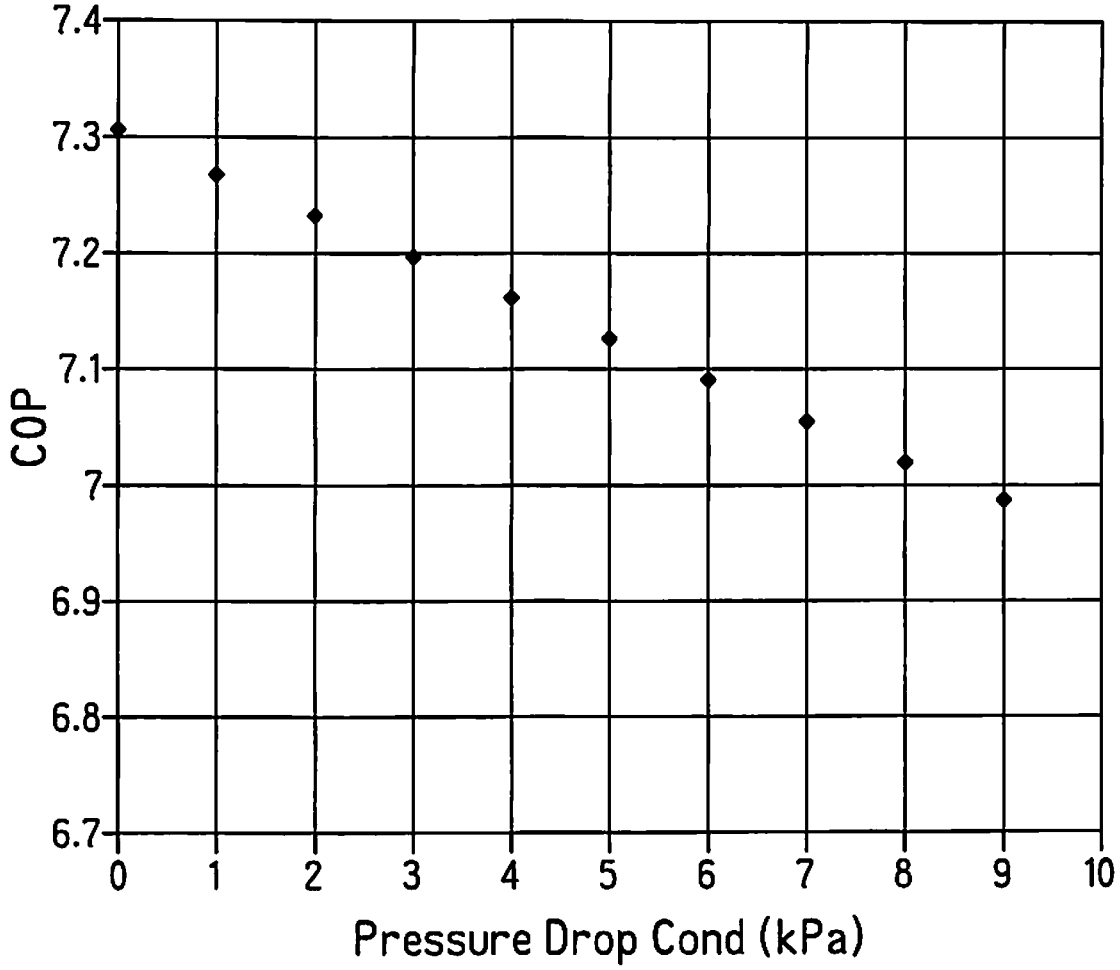
FIG. 11 is a graph illustrating a relationship between coefficient of performance (COP) and pressure drop of refrigerant passing downwardly through the tube bundle of a condenser.

Referring now to FIG. 11, FIG. 11 illustrates a relationship of COP (Coefficient of Performance) versus Condenser pressure drop. This FIG. 11 shows the reasoning behind the benefit of the illustrated embodiment. As can be seen in FIG. 11, as pressure drop gets larger COP gets smaller, as explained above. Therefore, it has been discovered that it is desirable to reduce the pressure drop in the condenser 3. It has further been discovered that by providing vapor passages as disclosed herein the pressure drop can be reduced. For example, in the arrangement shown in FIG. 12 a pressure drop of 2 kPa can be achieved. While this is relatively good performance, the arrangement in FIGS. 7-8 can reduce the pressure drop below 2 kPa. It has been discovered that, generally, COP (Coefficient of Performance) can be improved by maximizing a number of heat transfer tubes within a condenser (i.e., by theoretically maximizing heat transfer), such as is shown in FIG. 12. However, as explained above it has been further discovered that larger pressure drops can occur when the number of heat transfer tubes is maximized, which can decrease COP. However, it has been even further discovered that removing a minimal number of heat transfer tubes from the arrangement of FIG. 12 as explained with reference to the instant application embodiments, no appreciable drop in COP is caused by removing the tubes to make the vapor passage(s) explained and illustrated herein, and in fact COP can be improved as shown in FIG. 11.

Finally, while in the illustrated embodiments, the configurations of the vapor passages V1 and V2 are identical mirror images of each other, it will be apparent to those skilled in the art from this disclosure that these vapor passages do not have to be identical. Moreover, it is noted that the exact clearances (widths W1 and W2) can be optimized using Computational Fluid Dynamics (CFD) and will vary depending on the size of the system, size of the condenser, size of the heat transfer tubes, etc. However, one example for a C36 500t vessel (i.e., a 36 inch diameter vessel sized for 500 tons of cooling) is where W1=about 30 mm and W2=about 30 mm. The gap between the lower group is smaller than DO and thus, does not form a passage as define herein. However, it will be apparent to those skilled in the art from this disclosure that the gap between the smaller group can be larger than DO to further form passages (e.g., about 20 mm), as explained with reference to the second embodiment.

Second Embodiment

Figure 9:
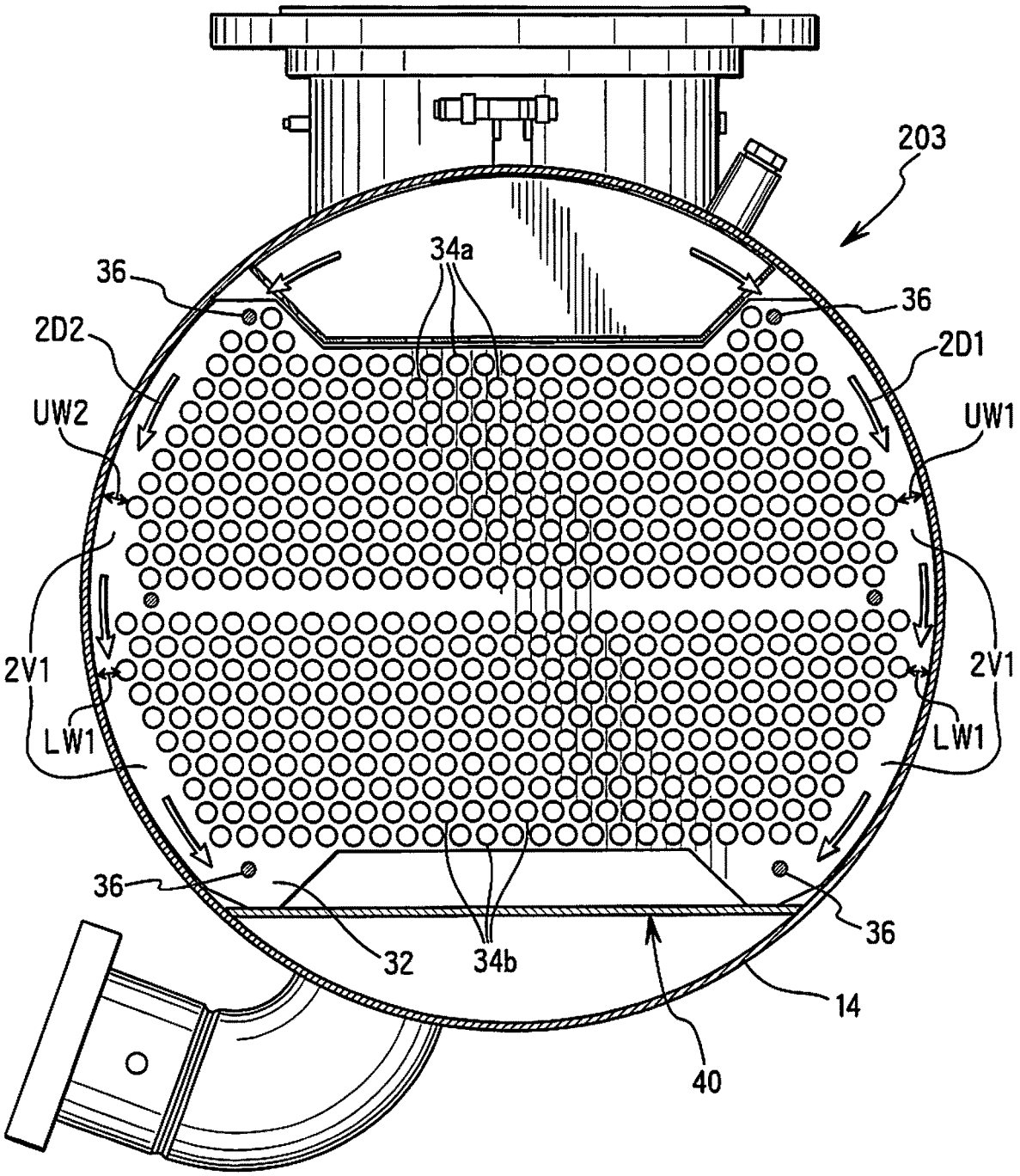
FIG. 9 is a simplified transverse cross sectional view of a condenser in accordance with a second embodiment.
Figure 10:
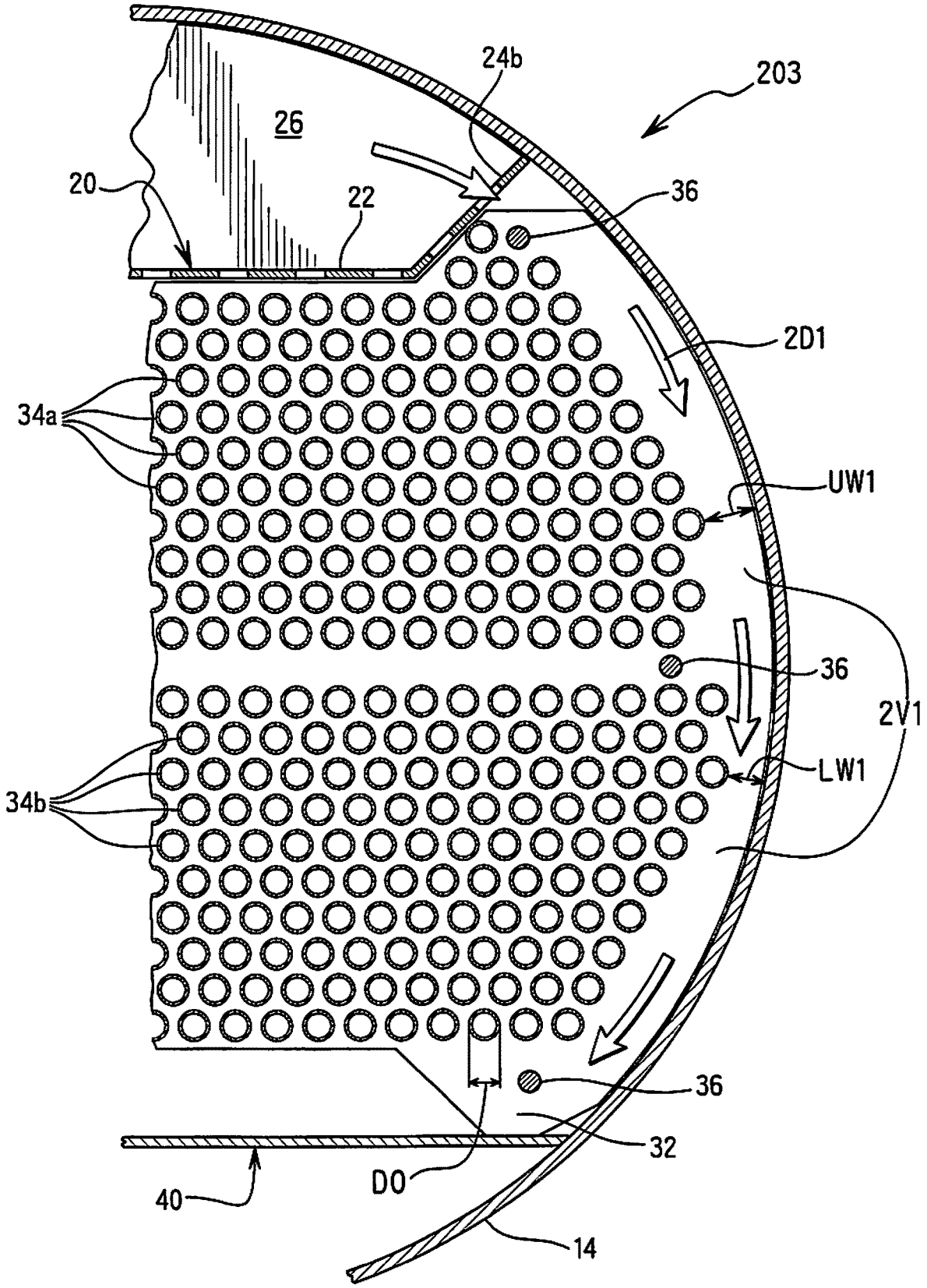
FIG. 10 is a further enlarged view of a right side of the condenser illustrated in FIG. 9 in accordance with a second embodiment.

Referring to FIGS. 9-10, a condenser 203 in accordance with a second embodiment of the present invention is illustrated. The condenser 203 is identical to the condenser 3 of the first embodiment, except the layout (pattern) of the heat transfer tubes 34*a* and 34*b* has been modified so that modified first and second vapor passages 2V1 and 2V2 are formed in accordance with this second embodiment. In view of the similarities between the first and second embodiments, the descriptions and illustrations of the first embodiment also apply to this second embodiment, except as explained herein. Moreover, in view of the similarities between the first and second embodiments, the same reference numerals are used for parts of this second embodiment as identical or functionally identical parts of the first embodiment.

As mentioned above, the layout (pattern) of the heat transfer tubes 34*a* and 34*b* has been modified so that modified first and second vapor passages 2V1 and 2V2 are formed in accordance with this second embodiment, which extend along arc-shaped first and second passage lengthwise directions 2D1 and 2D2, respectively. Specifically, modified support plates 232 are provided with hole patterns matching the layout of FIG. 9. Otherwise, the support plates 232 are identical to the support plates 32 of the first embodiment.

Due to the modified tube layout, the first vapor passage 2V1 extends through the upper group of the heat transfer tubes 34*a* and the lower group of the heat transfer tubes 34*b*. Thus, an upper first minimum width UW1 of the first vapor passage 2V1 passing through the upper group of the heat transfer tubes 34*a* is larger than a lower first minimum width LW1 of the first vapor passage 2V1 passing through the lower group of the heat transfer tubes 34*b*. Likewise, due to the modified tube layout, the second vapor passage 2V2 extends through the upper group of the heat transfer tubes 34*a* and the lower group of the heat transfer tubes 34*b*. Thus, an upper second minimum width UW2 of the second vapor passage 2V2 passing through the upper group of the heat transfer tubes 34*a* is larger than a lower second minimum width LW2 of the second vapor passage 2V2 passing through the lower group of the heat transfer tubes 34*b*.

In the illustrated embodiment, the first upper minimum width UW1 is larger than 1.5 times the tube diameter DO and smaller than three times the tube diameter DO. In the illustrated embodiment, the first upper minimum width UW1 is slightly smaller than two times the tube diameter DO. Gaps between the remaining tubes 34*a* in the upper group are larger than UW1, e.g., ranging from about two times the tube diameter DO to slightly less than three times the tube diameter DO (bottom row tube and $3^{rd}$ from the bottom row tube of the upper group). Likewise, in the illustrated embodiment, the second upper minimum width UW2 is larger than 1.5 times the tube diameter DO and smaller than three times the tube diameter DO. In the illustrated embodiment, the vapor passages 2V1 and 2V2 are mirror images of each other, and thus, it will be apparent to those skilled in the art from this disclosure that that descriptions/illustrations of one side also apply to the other side.

Moreover, it will be apparent to those skilled in the art from this disclosure that this embodiment is merely one example, and that the upper part of the condenser 203 could be replaced with the upper part of the condenser 3 of the first embodiment, discussed above, and vice versa. The lower parts of the passages 2V1 and 2V2 are vertical mirror images of the upper parts, except an additional tube is added to the top row and the third from the top row on each side such that the gaps LW1 and LW2 are smaller than UW1 and UW2, respectively, and the maximum gap size is also smaller. It will be apparent that additional tubes (e.g., 5) could be added on each side of the lower group such as are illustrated in FIGS. 7-8 and 12 so that the gaps at the bottom of the lower group is smaller than as shown in FIGS. 9-10. This can be done because when the refrigerant reach this location, most of the refrigerant will have been condensed. With such an arrangement the width of the gaps on each side of the condenser 203 will generally gradually decrease as the gaps extend vertically downwardly. However at the five bottom most rows the gap would be smaller than the tube diameter DO as understood from FIGS. 7-8.

The first and second passage lengthwise directions 2D1 and 2D2 are identical to the first and second passage lengthwise directions D1 and D2, respectively, except the first and second passage lengthwise directions 2D1 and 2D2 continue along the curvature of the cylindrical body 14 through the lower group of the heat transfer tubes. The upper first minimum width UW1 can be slightly smaller than the first width W1 of the first embodiment as illustrated herein (e.g., 10%) or can be identical. The lower first minimum width LW1 of the first vapor passage 2V1 passing through the lower group of the heat transfer tubes 34*b* can be for example 20 mm as mentioned above. Likewise, the upper second minimum width UW2 of the second vapor passage 2V2 passing through the upper group of the heat transfer tubes 34*a* can be slightly smaller than the second width W2 of the first embodiment as illustrated herein (e.g., 10%) or can be identical. The lower second minimum width LW2 of the second vapor passage 2V2 passing through the lower group of the heat transfer tubes 34*b* can be for example 20 mm as mentioned above. Specifically, in one example for a C36 500t vessel (i.e., a 36 inch diameter vessel sized for 500 tons of cooling) is where UW1=about 30 mm, UW2=about 30 mm, LW1=about 20 mm and LW2=about 20 mm. In other words, in the illustrated embodiment, both sides are mirror identical images of each other.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of a condenser when a longitudinal center axis thereof is oriented substantially horizontally as shown in FIGS. 4 and 5. Accordingly, these terms, as utilized to describe the present invention should be interpreted relative to a condenser as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A condenser adapted to be used in a vapor compression system, the condenser comprising:

a shell having a refrigerant inlet that at least refrigerant with gas refrigerant flows therethrough and a refrigerant outlet that at least refrigerant with liquid refrigerant flows therethrough, with a longitudinal center axis of the shell extending substantially parallel to a horizontal plane; and a tube bundle including a plurality of heat transfer tubes disposed inside of the shell so that the refrigerant discharged from the refrigerant inlet is supplied onto the tube bundle, the heat transfer tubes extending substantially parallel to the longitudinal center axis of the shell, the tube bundle including an upper group of the heat transfer tubes and a lower group of the heat transfer tubes disposed below the upper group of the heat transfer tubes, and at least a majority of the upper group of heat transfer tubes being disposed above the longitudinal center axis, the plurality of heat transfer tubes in the tube bundle being arranged to form a first vapor passage extending between the tube bundle and a first longitudinal sidewall of the shell and substantially vertically along a first passage lengthwise direction, and the first vapor passage extending past at least the upper group of the heat transfer tubes, the first vapor passage having a first minimum width measured perpendicularly relative to the first passage lengthwise direction and the longitudinal axis, the first minimum width being larger than a tube diameter of the heat transfer tubes of the tube bundle, and the first minimum width being smaller than four times the tube diameter, and each of the heat transfer tubes disposed above the longitudinal center axis of the heat exchanger and adjacent the first vapor passageway being spaced at least the tube diameter from the first sidewall and less than four times the tube diameter from the first sidewall as measured perpendicularly relative to the first passage lengthwise direction.

2. The condenser according to claim 1, wherein the first minimum width is larger than twice the tube diameter.

3. The condenser according to claim 1, wherein the first vapor passage extends past the upper group of the heat transfer tubes and the lower group of the heat transfer tubes.

4. The condenser according to claim 3, wherein the first minimum width of the first vapor passage is measured at the lower group of the heat transfer tubes.

5. The condenser according to claim 4, wherein the upper group of the heat transfer tubes is disposed at or above a vertical middle plane of the shell passing through the longitudinal center axis, and the lower group of the heat transfer tubes is disposed at or below the vertical middle plane of the shell.

6. The condenser according to claim 1, wherein the plurality of heat transfer tubes in the tube bundle are further arranged to form a second vapor passage extending between the tube bundle and a second longitudinal sidewall of the shell and substantially vertically along a second passage lengthwise direction, and the second vapor passage extends past at least the upper group of the heat transfer tubes, the second vapor passage has a second minimum width measured perpendicularly relative to the second passage lengthwise direction and the longitudinal axis, the second minimum width being larger than the tube diameter of the heat transfer tubes of the tube bundle, and the second minimum width being smaller than four times the tube diameter, and each of the heat transfer tubes of the upper group of the heat transfer tubes adjacent the second vapor passageway being spaced at least the tube diameter from the second sidewall and less than four times the tube diameter from the second sidewall as measured perpendicularly relative to the first passage lengthwise direction.

7. The condenser according to claim 6, wherein the first minimum width is larger than twice the tube diameter, and the second minimum width is larger than twice the tube diameter.

8. The condenser according to claim 6, wherein the first vapor passage extends past the upper group of the heat transfer tubes and the lower group of the heat transfer tubes, and the second vapor passage extends past the upper group of the heat transfer tubes and the lower group of the heat transfer tubes.

9. The condenser according to claim 8, wherein the first minimum width of the first vapor passage is measured at the lower group of the heat transfer tubes, and the second minimum width of the second vapor passage is measured at the lower group of the heat transfer tubes.

10. The condenser according to claim 9, wherein the upper group of the heat transfer tubes is disposed at or above a vertical middle plane of the shell passing through the longitudinal center axis, and the lower group of the heat transfer tubes is disposed at or below the vertical middle plane of the shell.

11. The condenser according to claim 1, wherein the refrigerant is R1233zd.

* * * * *